US005082269A

United States Patent [19]

Hirayama et al.

[11] Patent Number: 5,082,269

[45] Date of Patent: Jan. 21, 1992

[54] PAPER EJECTING DEVICE HAVING SHEET REVERSING AND NON-REVERSING POSITIONS

[75] Inventors: Takanobu Hirayama, Chita; Naohisa Kinoshita, Nagoya; Hiroyuki Kashima, Nagoya; Makoto Hasegawa, Nagoya; Toshihiro Tsuzuki, Kariya; Kiyoshi Muto, Yokkaichi, all of Japan

[73] Assignee: Brother Kogyo Kabushiki Kaisha, Aichi, Japan

[21] Appl. No.: 579,967

[22] Filed: Sep. 10, 1990

[30] Foreign Application Priority Data

Sep. 13, 1989 [JP] Japan ..... 1-237559

[51] Int. Cl.[5] ..... B65H 29/38

[52] U.S. Cl. ..... 271/65; 271/186; 271/213

[58] Field of Search ..... 271/291, 186, 65, 207, 271/213

[56] References Cited

U.S. PATENT DOCUMENTS

| | | | |
|---|---|---|---|
| 4,220,323 | 9/1980 | Smith | 271/213 X |
| 4,657,238 | 4/1987 | Nishikawa | 271/65 X |
| 4,671,503 | 6/1987 | Uemori | 271/65 |
| 4,712,785 | 12/1987 | Stemmle | 271/291 X |

*Primary Examiner*—Richard A. Schacher
*Attorney, Agent, or Firm*—Oliff & Berridge

[57] ABSTRACT

A paper ejecting device for ejecting a recording cut sheet cut of a recording apparatus is disclosed. The paper ejecting device includes an ejector for ejecting the recording cut sheet through an outlet which is provided at a portion of the recording apparatus, a tray disposed adjacent to the ejector for receiving and recording cut sheet which has been ejected through the outlet by the ejector, and a sheet reversing member operable between a first position for guiding and reversing the recording cut sheet ejected through the outlet before the sheet falls onto the tray, and a second position for permitting the recording cut sheet ejected through the outlet to be received on the tray, without a reversal of the cut sheet.

14 Claims, 3 Drawing Sheets

PAPER EJECTING DEVICE HAVING SHEET REVERSING AND NON-REVERSING POSITIONS

BACKGROUND OF THE INVENTION

1. Field of the Invention

The present invention relates to a paper ejecting device used in a printer, copying machine, facsimile apparatus or other recording apparatus, and more particularly to such a paper ejecting device which permits recording cut sheets ejected through an outlet of the recording apparatus, to be received on a tray with its printed surface facing in a selected one of upward and downward directions.

2. Discussion of the Prior Art

A known paper ejecting device generally includes (a) ejector means for ejecting a recording cut sheet through an outlet which is formed at one sheet feeding end of the recording apparatus, and (b) a tray disposed adjacent to the ejector means for receiving the recording cut sheet which has been ejected through the outlet. In most cases, the paper ejecting device is provided as a part of a recording apparatus such as a printer. During a printing operation of a printer, for example, the recording cut sheet on which an image has been formed is passed through the outlet of the printer by the ejector means, and then received on the tray.

The recording cut sheets may be ejected onto the tray with their printed surfaces facing up, or with their printed surfaces facing the sheet receiving surface of the tray. Conventionally, the paper ejecting device is provided with two paper outlets, and two parallel discharge paths corresponding to these two outlets, so that the recording sheets passed through one of the two outlets can be reversed by a suitable mechanism provided in the corresponding discharge path. Thus, the recording sheets can be ejected with their printing surfaces facing in the desired upward or downward direction, by providing a plurality of paper outlets, and selecting one of the corresponding discharge paths, depending upon whether the sheets should be reversed or not.

However, the known paper ejecting device is required to have a plurality of trays for receiving the recording sheets from the respective paper outlets, ejector means for feeding the sheets into the respective discharge paths, and switching means for directing the recorded sheets toward the selected one of the paper outlets. Thus, the known arrangement requires an increased number of components, which inevitably pushes up the cost of manufacture of the device. Further, the paper ejecting device of the above type is rather complicated in construction, and is therefore likely to suffer from a paper jam. Moreover, the device as a whole tends to be relatively large-sized, requiring an accordingly large installation space for the device.

SUMMARY OF THE INVENTION

It is therefore an object of the present invention to provide a paper ejecting device which is simple in construction, and is capable of ejecting a recording cut sheet with its printed surface facing in a desired one of upward and downward directions.

The above object may be achieved according to the principle of the present invention, which provides a paper ejecting device for ejecting a recording cut sheet out of a recording apparatus, the paper ejecting device having ejector means for ejecting the recording cut sheet through an outlet which is provided at a portion of the recording apparatus, a tray disposed adjacent to the ejector means for receiving the recording cut sheet which has been ejected through the outlet by the ejector means, and a sheet reversing member operable between a first position for guiding and reversing the recording cut sheet ejected through the outlet before the sheet falls onto the tray, and a second position for permitting the recording cut sheet ejected through the outlet to be received on the tray, without a reversal of the cut sheet.

In the thus constructed paper ejecting device, the recording cut sheet is passed through the outlet by the ejecting means, and then received on the tray, with or without the sheet being reversed by the sheet reversing member as needed. In the case where the recording sheets are ejected from the recording apparatus with their printed surfaces facing upward, for example, the sheet reversing member is operated to the second position in which the sheets are not reversed when the sheets are required to be received on the tray without their printed surfaces turned upside down. When the recording sheets are required to be received on the tray with their printed surfaces turned upside down, the sheet reversing member is operated to the first position in which the sheet are reversed. Thus, the paper ejecting device of the present invention is capable of easily reversing the recording cut sheet which is ejected through the outlet before it is received on the tray.

Since the present paper ejecting device has only one outlet leading to a single discharge path, the device only requires one tray and one ejector for ejecting the recording cut sheets from the recording apparatus. Thus, the present devices requires a reduced number of components, and therefore may be produced at a reduced cost. Further, the present paper ejecting device is relatively simple in construction since the sheet reversing member is disposed outside the paper outlet usually formed at one sheet feeding end of the recording apparatus. Accordingly, the device is less likely to suffer from a paper jam, and may be made small-sized and therefore installed in a relatively small space.

BRIEF DESCRIPTION OF THE DRAWINGS

The above and other objects, features and advantages of the present invention will be better understood by reading the following detailed description of a presently preferred embodiment of the invention, when considered in connection with the accompanying drawings, in which.

DETAILED DESCRIPTION OF THE PREFERRED EMBODIMENT

Figure 1:
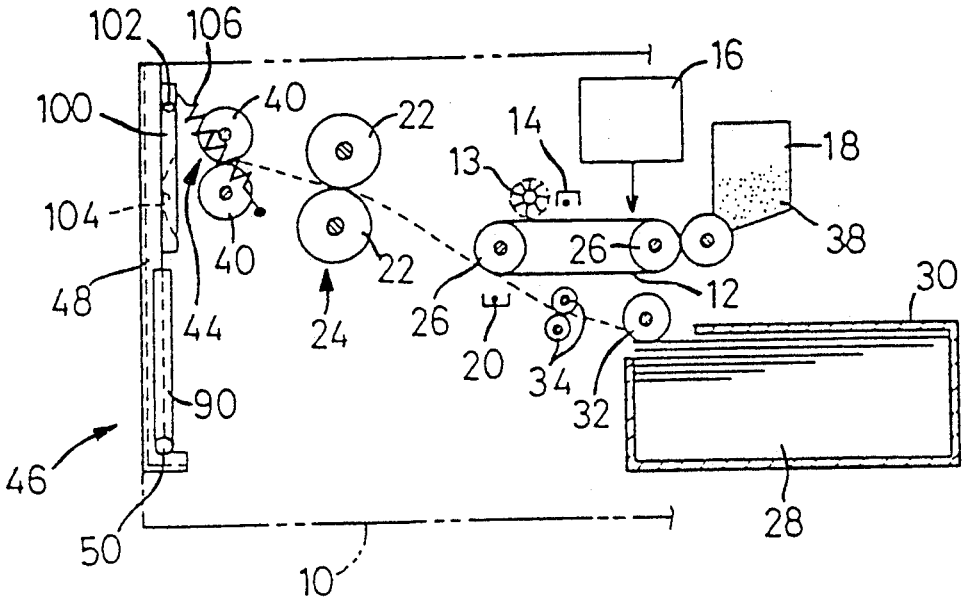
FIG. 1 is a front elevational view in cross section of a laser printer which incorporates one embodiment of the present invention in the form of a paper ejecting device.

Referring first to FIG. 1, there is shown a laser printer incorporating one embodiment of the present invention in the form of a paper ejecting device. The laser printer has a housing body 10 as indicated in a two-dot chain line in FIG. 1. Within the housing body 10, there are accommodated a photosensitive endless belt 12, a cleaner 13, a corona charger 14, a laser exposing device 16, a developing device 18, an image transfer device 20, an image fixing device 24 having a pair of fixing rolls 22, and other components. The photosensitive endless belt 12 engages a pair of rolls 26, so that the endless belt 12 may be continuously rotated by the rolls 26 when the rolls 26 are rotated in the same direction at the same rate. Below the photosensitive endless belt 12, there are disposed a sheet cassette 30 for accommodating a stack of recording cut sheets 28, a pick-up roll 32 for delivering the cut sheets 28 one after another, and a pair of guide rolls 34 for guiding the delivered cut sheets 28. As shown in FIG. 1, the pick-up roll 32 is located adjacent the sheet cassette 30, and the guide rolls 34 are disposed between the pick-up roll 32 and the image transfer device 20.

In a laser printing operation of the present laser printer, the photosensitive endless belt 12 which is moved by the rolls 26 is electrostatically uniformly charged by the corona charger 14. Then, the endless belt 12 is image-wise exposed to a laser beam which is generated from the laser exposing device 16, so that a latent image is formed on the outer surface of the belt 12. This latent image is developed into a visible image by application of a toner 38 by the developing device 18 to the appropriate local spots on the belt 12, according to the source image information represented by the laser beam. Thereafter, the visible image of the toner 38 is transferred by the image transfer device 20 to the cut sheet 28. The sheet 28 is delivered from the sheet cassette 30 by the pick-up roll 32, and is guided by the guide rolls 34 toward the image transfer device 20, along a path as indicated by a one-dot chain line in FIG. 1. After the image transferring operation, the sheet 28 is fed to the image fixing device 24, so that the toner 38 on the sheet 28 is fixed by the fixing rolls 22 of the device 24. At the same time, the photosensitive endless belt 12 is cleaned by the cleaner 13 to remove the remaining particles of the toner 38, and is subsequently charged by the corona charger 14 for the next printing operation on the next cut sheet 28.

A pair of ejector rolls 40 are disposed on the downstream side (left-hand side in FIG. 1) of the image fixing device 24. After the image on the sheet 28 is fixed by the fixing rolls 22 of the device 24, the sheet 28 is ejected through the nip of the ejector rolls 40, such that the image-bearing or printed surface of the sheet 28 faces upward as viewed in FIG. 1. In the instant embodiment, the ejector rolls 40 serve as ejector means for ejecting the sheet 28 out of the printer, through a sheet outlet 44 which is partially defined by the pressure nip between the ejector rolls 40.

Figure 4:
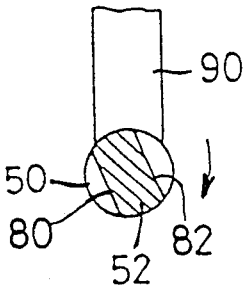
FIG. 4 is an enlarged front elevational view showing an engaging portion of a rotary shaft and a part of a slidable member.

Below the sheet outlet 44 slightly off to the left as viewed in FIG. 1, there is provided a tray 46 on which the sheets 28 leaving the ejector rolls 40 are received. The tray 46 includes a sheet receiving portion 48 for receiving and supporting the sheets 28 which are ejected through the sheet outlet 44, and a pair of rotary shafts 50 which respectively protrude from the opposite sides of the proximal end portion of the tray 46, in the opposite directions perpendicular to the direction in which the sheet 28 is ejected by the rolls 40. The sheet receiving portion 48 and the rotary shafts 50 are moved as a unit when the tray 46 is selectively placed in one of three states as described later. As also described later, the sheet receiving portion 48 is pivotable about the axis of the rotary shafts 50. Each of the rotary shafts 50 has two cutouts formed by cutting off diametrically opposite segments of a portion of the shaft 50 adjacent to its distal end, such that each cutout has a rectangular cross sectional shape and extends in a direction perpendicular to the axis of the shaft 50. The thus formed cutouts of each shaft 50 provide respective flat faces 80, 82 (FIGS. 4 and 6) which define an engaging portion 52 therebetween. That is, the engaging portion 52 has a cross sectional shape defined by two parallel straight lines and diametrically opposite arcs as shown in FIG. 4. Within the housing body 10, on the other hand, a pair of guide plates 54 (one of which is indicated by a two-dot chain line in FIG. 5) are fixedly disposed parallel to each other. The guide plates 54 have respective guide grooves 56 which are slidably engageable with the engaging portions 52 of the corresponding rotary shafts 50. With the engaging portions 52 of the rotary shafts 50 being held in engagement with the guide grooves 56 of the respective guide plates 54, the tray 46 is movably attached to the housing body 10, through the guide plates 54.

Figure 6:
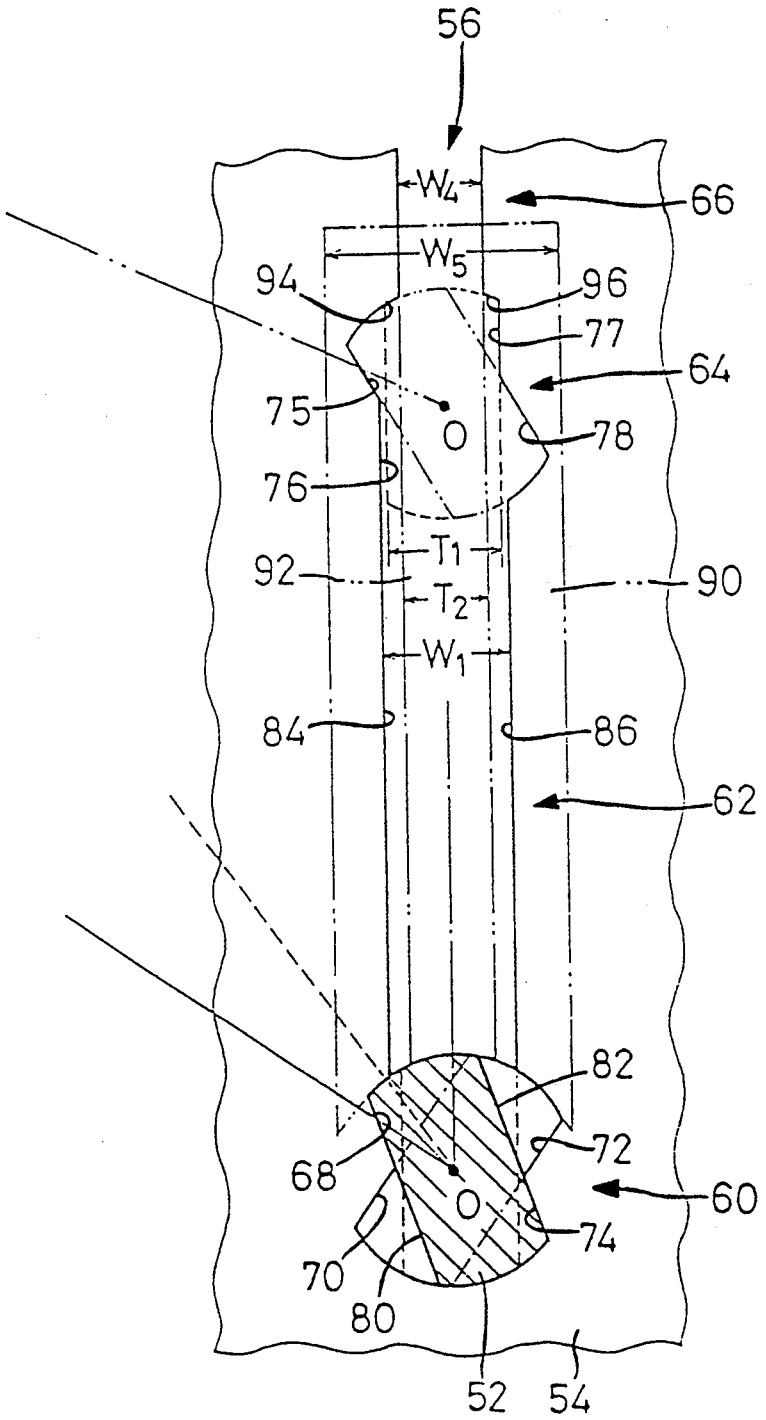
FIG. 6 is an enlarged front elevational view showing a part of the paper ejecting device of FIG. 1.

As shown in FIG. 6, each of the guide grooves 56 has a first stopper portion 60, a first guide portion 62, a second stopper portion 64, and a second guide portion 66, which are formed in the order of description from the bottom to the top of the guide plate 52. The first and second stopper portions 60, 62 have respective profiles corresponding to the path or locus described by the outline of the engaging portion 52 when the rotary shaft 50 is rotated about its axis O over respective predetermined angular ranges. The first guide portion 62 provides a vertically extending straight groove which has a width W1 slightly larger than a thickness T1 of the engaging portion 52 of the shaft 50. The first stopper portion 60 has stopper surfaces 68, 70, 72, 74, while the second stopper portion 62 has stopper surfaces 75, 76, 77, 78, so that the stopper surfaces 68, 70, 72, 74, 75, 76, 77, 78 determine the above-indicated angular ranges of rotation of the engaging portion 52 when the portion 52 is rotated in the first and second stopper portions 60, 64. Namely, when the engaging portion 52 is rotated in the counterclockwise direction while the portion 52 is located in the first stopper portion 60, upper and lower portions of the opposite flat faces 80, 82 of the engaging portion 52 abut on the stopper surfaces 68, 74, respectively, so that the engaging portion 52 is held in a first angular position. When the engaging portion 52 located in the first stopper portion 60 is rotated in the clockwise direction, lower and upper portions of the opposite flat faces 80, 82 of the engaging portion 52 abut on the stopper surfaces 70, 72, respectively, so that the engaging portion 52 is held in a second angular position. When the engaging portion 52 is rotated in the clockwise direction while the portion 52 is located in the second stopper portion 64, the opposite flat faces 80, 82 thereof abut on the stopper surfaces 76, 77 so that the engaging portion 52 is held in a third angular position. When the engaging portion 52 located in the second stopper portion 64 is rotated in the counterclockwise direction, the opposite flat faces 80, 82 thereof abut on the stopper surfaces 75, 78, whereby the engaging portion 52 is held in a fourth angular position. Since the width W1 of the first guide portion 62 is made slightly larger than the thickness T1 of the engaging portion 52, as described above, the engaging portion 52 can be easily moved from the first or second stopper portion 60, 64, into the first guide portion 62, when the engaging portion 52 is placed in an intermediate angular position in which its opposite flat faces 80, 82 extend in a direction parallel to opposite guide walls 84, 86 of the first guide portion 62. It is to be noted that this intermediate angular position of the engaging portion 52 is identical with the third angular position as indicated above with respect to the stopper surfaces 76, 77 of the second stopper portion 64. Accordingly, the intermediate angular position will be hereinafter referred to as "third angular position" when appropriate. In the first guide portion 62, the engaging portion 52 is movable in the vertical direction as seen in FIG. 6 while being guided by the guide walls 84, 86. It is also to be noted that the stopper surfaces 76, 77 of the second stopper portion 64 lie in the same plane as the guide walls 84, 86 of the first guide portion 62, respectively.

Since the sheet receiving portion 48 and the rotary shafts 50 of the tray 46 are rotated or pivoted and moved as a unit, as described above, the rotation of the engaging portions 52 of the rotary shafts 50 changes the angle of inclination of the sheet receiving portion 48 with respect to the housing body 10 of the laser printer. When the engaging portions 52 are located in the first stopper portion 60 and held in the first angular position, the tray 46 is held in a first state as indicated in a solid line in FIG. 6, in which the sheet receiving portion 48 is inclined about 60 degrees in the counterclockwise direction, with respect to the vertical as viewed in the plane of the guide plates 54. When the engaging portions 52 are located in the first stopper portion 60 and held in the second angular position, the tray 46 is held in a second state as indicated in a one-dot chain line in FIG. 6, in which the sheet receiving portion 48 stands upright or extends in the vertical direction as shown in FIG. 1. In this second state, the tray 46 is placed in its inoperative position. When the engaging portion 52 is located in the first stopper portion 60 are placed in the third or intermediate angular position, the tray 46 is held in a third state as indicated in a broken line in FIG. 6, so that the engaging portions 52 can be moved from the first stopper portion 60 toward the second stopper portion 64, through the first guide portion 62. When the engaging portions 52 are located in the second stopper portion 64 and held in the fourth angular position, the tray 46 is held in a fourth state as indicated in a two-dot chain line in FIG. 6, in which the sheet receiving portion 48 is inclined about 70 degrees in the counterclockwise direction, with respect to the vertical. In the instant embodiment, the operator of the printer operates the tray 46 at its sheet receiving portion 48, so as to effect the rotary and vertical movements of the rotary shafts 50.

Figure 5:
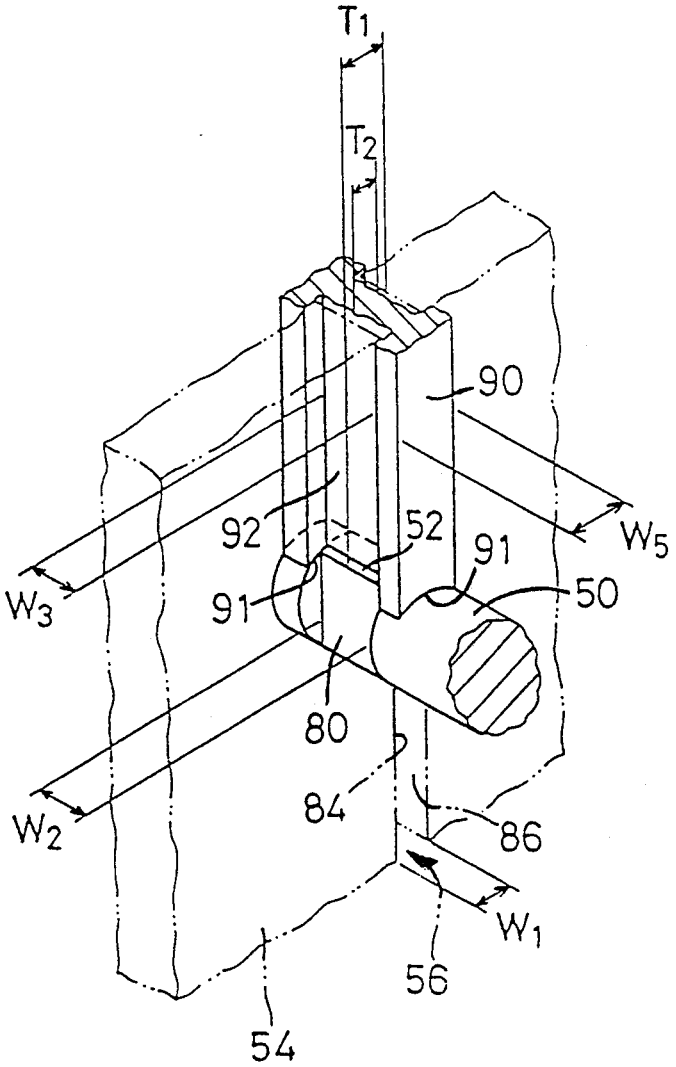
FIG. 5 is an enlarged perspective view showing a part of the paper ejecting device of FIG. 1.

Just above the rotary shafts 50, there are provided respective slidable members 90 one of which is partially shown in FIG. 5. Each of the slidable members 90 has an H-shaped cross section, that is, consists of opposite side portions, and a thin-walled engaging portion 92 which engages the guide groove 56 of the corresponding guide plate 54, like the engaging portion 52 of the rotary shaft 50. The engaging portion 92 of the slidable member 90 has a width W3 (as measured in the direction of thickness of the guide plate 54) which is equal to the width W2 of the engaging portion 52 of the shaft 50, and a thickness T2 smaller than the thickness T1 of the engaging portion 52. Each of the opposite side portions of the slidable member 90 has an arcuate end face 91 which follows the outer circumferential surface of the rotary shaft 50. Accordingly, the arcuate end faces 91 of the opposite side portions of the slidable member 90 are slidably fitted on the corresponding portions of the rotary shaft 50 between which the engaging portion 52 is interposed, whereby the slidable member 90 is stably supported by the rotary shaft 50. When the engaging portion 52 of the rotary shaft 50 is located in the first stopper portion 60 of the guide groove 56, most of the engaging portion 92 of the slidable member 90 is accommodated within the first guide portion 62 with its uppermost portion being slidably fitted in the second guide portion 66, as indicated in a two-dot chain line in FIG. 6. When the engaging portion 52 of the rotary shaft 50 is vertically moved within the first guide portion 62, the slidable member 90 which engages the shaft 50 is accordingly moved in the vertical direction. The width W4 of the second guide portion 66 is determined to accommodate only the engaging portion 92 of the slidable member 90, so that the upward movement of the engaging portion 52 of the shaft 50 is limited by the inner surfaces 94, 96 of the guide plate 54 which partially define the second stopper portion 64 of the groove 56. Although there exist considerable clearances between the opposite surfaces of the engaging portion 92 and the respective guide walls 84, 86 of the first guide portion 62, the engaging portion 92 is prevented from being moved in the direction of width of the guide portion 62 since the slidable member 90 and the rotary shaft 50 are held in engagement with each other, and the upper part of the engaging portion 92 snugly extends through the second guide portion 66. The slidable member 90 has a width W5 which is larger than the width W1 of the first guide portion 62 of the groove 56, so that the slidable member 90 is prevented from being disengaged from the first guide portion 62.

Figure 2:
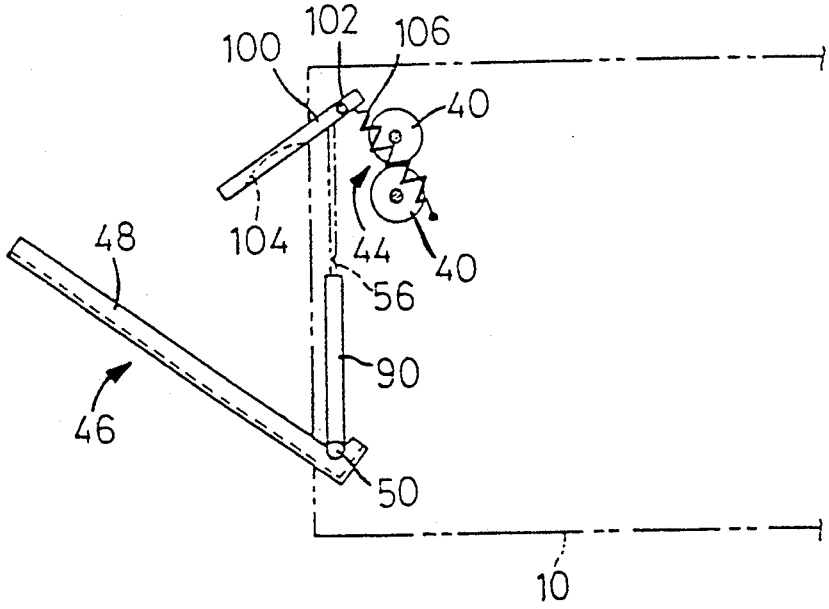
FIGS. 2 and 3 are front elevational views in cross section each showing the paper ejecting device of the laser printer, FIG. 2 being a view of the device held in a sheet reversing position, FIG. 3 being a view of the device held in a sheet non-reversing position.
Figure 3:
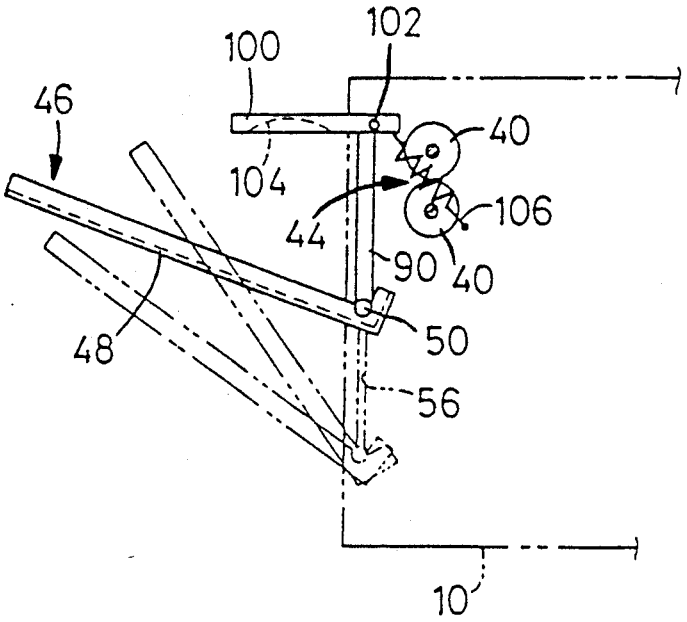

The instant paper ejecting device further includes a sheet reversing member 100 which is disposed above the tray 46. This sheet reversing member 100 is pivotally attached at its opposite sides to the corresponding guide plates 54 by means of pins 102, such that the member 100 is pivotable about the pins 102 which are located in the vicinity of the ejector rolls 40 and the upper ends of the guide grooves 56. The sheet reversing member 100 has a curved guide surface 104 which is formed by cutting out a middle portion of one major surface thereof on the side of the ejector rolls 40. A pair of springs 106 are provided for connecting one end of the sheet reversing member 100 and the guide plates 54. With substantially no load applied to the spring 106, the sheet reversing member 100 is maintained by the spring 106 in a sheet-reversing position as shown in FIG. 2, such that the member 100 is inclined about 60 degrees in the clockwise direction with respect to the vertical. When the tray 46 is pivoted to the inoperative position or brought to the second state in which it stands upright as shown in FIG. 1, the sheet reversing member 100 is pivoted by the sheet receiving portion 48 of the tray 46, to an upright inoperative position adjacent to the sheet outlet 44, against the biasing force of the spring 106. In this condition, the opening of the housing body 10 on the side of the sheet outlet 44 is closed by the tray 46, which is held in the second state by suitable latch means. When the tray 46 is moved upwards by the operator as shown in FIG. 3, the slidable members 90 are accordingly moved upwards until the upper ends of the members 90 abut on the sheet reversing member 100. Consequently, the sheet reversing member 100 is pivoted in the clockwise direction from the sheet-reversing position described above to a non-reversing position in which the sheet reversing member 100 lies in the substantially horizontal plane, i.e., extends in a direction substantially parallel to the top or bottom wall of the housing body 10. In this condition of FIG. 3, the sheet reversing member 100 in the non-reversing position and the sheet receiving portion 48 of the tray 46 form a relatively small angle on the side of the guide surface 104 of the member 100. This angle is considerably smaller than the corresponding angle (about 70°) in the condition of FIG. 2 in which the member 100 is placed in the sheet-reversing position.

In the thus constructed laser printer, a paper ejecting operation of the paper ejecting device will be effected in the following manner.

While no printing operation is effected on the laser printer, the tray 46 is placed in the second or inoperative state, and is maintained in this state by suitable latch means. In this state, the sheet reversing member 100 is held in the upright inoperative position by means of the tray 46, with no interference with the slidable members 90 which are located in the lower half of the guide grooves 56, as shown in FIG. 1.

When it is desired that the sheets 28 are received on the tray 46 during the printing operation, with the printed surface of each sheet 28 facing the sheet receiving portion 48, the operator operates the tray 46 to be placed into the first state as shown in FIG. 2, in which the sheet receiving portion 48 is inclined about 60 degrees in the counterclockwise direction with respect to the vertical. As a result, the sheet reversing member 100 is pivoted from the upright inoperative position to the sheet-reversing position under the biasing action of the spring 106, so that the angle formed by the sheet reversing member 100 and the sheet receiving portion 48 of the tray 46 is around 70 degrees on the side of the guide surface 104. In this arrangement, when the cut sheet 28 is ejected through the sheet outlet 44 by the ejector rolls 40, the leading end of the sheet 28 is brought into contact with the curved guide surface 104 on the sheet reversing member 100, so that the sheet 28 is guided along the guide surface 104 and is thereby buckled with its printed surface facing outwards. Consequently, the sheet 28 is turned upside down, and falls onto the sheet receiving portion 48 of the tray 46, with the printed surface facing downward. Since there is a sufficient vertical distance between the sheet reversing member 100 and the tray 46, the sheet 28 can be completely reversed while the sheet 28 is guided along the arc of the guide surface 104. Further, the angle formed by the printed surface of the buckled leading end portion of the falling sheet 28 and the upper surface of the sheet receiving portion 48 is relatively acute when the leading end of the sheet 28 comes into contact with the sheet receiving portion 48 of the tray 46. Consequently, the sheet 28 is received by the sheet receiving portion 48 with the printed surface facing downward without fail. In this case, too, the slidable members 90 do not interfere with the sheet reversing member 100.

When it is desired that the printed sheets 28 are received on the tray 46 with the printed surfaces facing upward or facing the sheet reversing member 100, the operator operates the tray 46 to be pivoted into the third state, so that the rotary shafts 50 are rotated in the clockwise direction to bring the engaging portions 52 of the shafts 50 to the third angular position. Then, the operator pushes up the tray 46 so that the engaging portion 52 of each shaft 50 is elevated from the first stopper portion 60 of the guide groove 56 to the second stopper portion 64, through the first guide portion 62, until each engaging portion 52 abuts on the inner surfaces 94, 96 of the second stopper portion 64. Namely, the rotary shaft 50 and the sheet receiving portion 48 of the tray 46 are moved as a unit in the upward direction toward the sheet reversing member 100. When the engaging portion 52 reaches the second stopper portion 64, the operator operates the tray 46 to be pivoted in the counterclockwise direction into the fourth state as indicated by a solid line in FIG. 3, so that the engaging portion 52 of the shaft 50 is rotated in the same direction. With the opposite flat faces 80, 82 of the engaging portion 52 abutting on the stopper surfaces 75, 78, the tray 48 is maintained in this fourth state.

When the rotary shafts 50 are elevated as described above, the slidable members 90 engaging the shafts 50 are also elevated so as to cause the sheet reversing member 100 to be pivoted to the non-reversing position as shown in FIG. 3. Accordingly, the sheet 28 which is ejected through the sheet outlet 44 falls directly onto the tray 46 without contacting the sheet reversing member 100, so that the sheet 28 is received on the sheet receiving portion 48 with its printed surface facing upward. As shown in FIG. 3, the tray 46 is located in the vicinity of the sheet outlet 44, and the sheet reversing member 100 extends in a direction substantially parallel to the sheet receiving portion 48 of the tray 46. Therefore, the angle formed by the printed surface of the leading end portion of the sheet 28 and the upper surface of the sheet receiving portion 48 is obtuse when the almost straight leading end of the sheet 28 comes into contact with the sheet receiving portion 48 of the tray 46. Accordingly, the sheet 28 is received on the sheet receiving portion 48 without being reversed, even if the sheet 28 contacts the sheet reversing member 100.

In the instant embodiment, the sheet reversing member 100 is automatically placed in the selected one of the upright, sheet-reversing, and non-reversing positions by utilizing the pivotal motion of the tray 46, biasing action of the spring 106 and the vertical motion of the slidable member 90, respectively. Thus, the instant paper ejecting device can be more efficiently switched selectively to one of the three operating positions as shown in FIGS. 1–3, as compared with when the sheet reversing member 100 is also manually operated by the operator. Further, since the height and angle of inclination of the tray 46 are changed depending upon the currently selected position of the sheet reversing member 100, the instant paper ejecting device is able to permit the sheets 28 to be surely received on the sheet receiving portion 48 with the printed surface of each sheet 28 facing in the desired one of the upward and downward directions.

In the illustrated embodiment, the opening of the housing body 10 is closed by the tray 46, as shown in FIG. 1, while no printing operation is effected on the printer. This arrangement effectively prevents entry of dust or other foreign matters into the housing body 10, whereby the interior of the laser printer can be kept clean.

Further, the tray 46 and the sheet reversing member 100 are accommodated within the laser printer while the opening of the housing body 10 is closed by the tray 46. Accordingly, the printer incorporating the paper ejecting device can be made compact while the printer is at rest.

According to the present invention, the recording cut sheets can be reversed or turned upside down even if the paper ejecting device is modified such that the tray for receiving the sheets is fixed in position at a given height with a given angle of inclination. Further, the sheet reversing member may be manually operated by the operator so that the member is placed in the selected one of the three positions indicated above. Alternatively, the sheet reversing member may be moved by a suitable member or members other than the tray 46, spring 106 and slidable member 90 as used in the illustrated embodiment.

While the present invention has been described above in the presently preferred embodiment, it is to be understood that the invention is not limited to the details of the illustrated embodiment, but may be embodied with various changes, modifications and improvements, which may be occur to those skilled in the art, without departing from the spirit and scope of the invention defined in the appended claims. For example, the instant paper ejecting device may be used in a copying machine or other recording apparatus.

What is claimed is:

1. A paper ejecting device for ejecting a recording cut sheet out of a recording apparatus, comprising:

ejector means for ejecting said recording cut sheet through an outlet which is provided at a portion of the recording apparatus;

a tray disposed adjacent to said ejector means and comprising a sheet receiving portion for receiving said recording cut sheet which has been ejected through said outlet by said ejector means;

a sheet reversing member disposed above said tray and operable between a first position for guiding and reversing said recording cut sheet ejected through said outlet before the sheet falls onto said sheet receiving portion of said tray, and a second position for permitting said recording cut sheet ejected through said outlet to be received on said sheet receiving portion, without a reversal of said cut sheet, said sheet reversing member having a lower guiding surface; and a guide portion for supporting said tray selectively at two different levels with respect to said sheet reversing member, said guide portion including guiding means for guiding said tray between said two different levels, said guide portion supporting said tray such that said sheet receiving portion of the tray placed at a lower one of said two different levels and said sheet reversing member placed in said first position form a first angle on the side of said lower guiding surface of said sheet reversing member, while said sheet receiving portion of the tray placed at a higher one of said two different levels and said sheet reversing member placed in said second position form a second angle on the side of said lower guiding surface, said first angle being larger than said second angle and being determined so that said recording cut sheet is reversed with a leading end portion thereof being guided along said lower guiding surface.

2. A paper ejecting device according to claim 1, wherein said tray further comprises a rotary shaft portion fixed to an end portion of said sheet receiving portion, said guide portion supporting and guiding said tray such that said sheet receiving portion is pivotable about an axis of said rotary shaft portion which is substantially perpendicular to a direction in which said cut sheet is ejected by said ejector means.

3. A paper ejecting device according to claim 1, further comprising linking means for abutting contact with said sheet reversing member to move said sheet reversing member from said first position to said second position when said tray is moved to a higher one of said two different levels.

4. A paper ejecting device according to claim 3, wherein said linking means comprises at least one slidable member which slidably engages said guiding means and said rotary shaft portion, such that said at least one slidable member is moved with said rotary shaft portion.

5. A paper ejecting device according to claim 4, wherein said guiding means comprises a first guide groove for guiding rotary shaft portion, and a second guide groove for guiding said at least one slidable member, said first and second guide grooves being parallel to each other.

6. A paper ejecting device according to claim 3, wherein said guide portion has a first stopper portion engageable with said rotary shaft portion for holding said tray at a lower one of said two different levels, and a second stopper portion engageable with said rotary shaft portion for holding said tray at said higher level, said guiding means being provided between said first and second stopper portions.

7. A paper ejecting device according to claim 6, wherein said rotary shaft portion includes an engaging portion which is engageable with said guiding means, and is engageable with said first and second stopper portions such that said first and second angles are formed at said lower and higher levels, respectively.

8. A paper ejecting device according to claim 1, further comprising biasing means for holding said sheet reversing member in said first position when said tray is placed in an operative position.

9. A paper ejecting device according to claim 8, wherein said sheet reversing member further has an inoperative position, and said tray has an inoperative position in which said tray holds said sheet reversing member in said inoperative position against a biasing action of said biasing means.

10. A paper ejecting device according to claim 1, wherein said ejector means consists of a pair of ejector rolls, and wherein said outlet is partially defined by a nip formed by and between said pair of ejector rolls.

11. A paper ejecting device for ejecting a recording cut sheet out of a recording apparatus, comprising:

ejector means for ejecting said recording cut sheet through an outlet which is provided at a portion of the recording apparatus;

a tray disposed adjacent to said ejector means for receiving said recording cut sheet which has been ejected through said outlet by said ejector means;

a sheet reversing member operable between a first position for guiding and reversing said recording cut sheet ejected through said outlet before the sheet falls onto said tray, a second position for permitting said recording cut sheet ejected through said outlet to be received on said tray, without reversal of said cut sheet, and a third position in which said sheet reversing member is accommodated in said recording apparatus; and a guide portion for supporting said tray selectively at two different levels with respect to said sheet reversing member, said guide portion including guiding means for guiding said tray between said two different levels, said guide portion having a first stopper portion for selectively holding said tray in one of a first and a second angular position, and a second stopper portion for selectively holding said tray in one of a third and a fourth angular position, said guiding means being provided between said first and second stopper portions, to move said tray therebetween while the tray is placed in said third angular position, said first and second stopper portions corresponding to a lower and a higher one of said two different levels of the tray, respectively, said first and second positions of said sheet reversing member being established when said tray is placed in said first and fourth angular positions, respectively, said tray when placed in said second angular position being accommodated in said recording apparatus when said tray is placed in said second angular position, and said third position of said reversing member being established when said tray is moved to said second angular position.

12. A paper ejecting device according to claim 11, wherein said guiding means comprises a guide groove, and said rotary shaft portion comprises a round shaft including an engaging portion having two opposite parallel flat faces which are parallel to an axis of rotation of said round shaft, said parallel flat faces slidably engaging said guide groove, said first stopper portion having stopper surfaces which abut on said parallel flat faces for determining said first and second angular positions and said second stopper portion having stopper surfaces for determining said third and fourth angular positions.

13. A paper ejecting device for ejecting a recording cut sheet out of a recording apparatus, comprising:

ejector means for ejecting said recording cut sheet through a single outlet which is provided at a portion of the recording apparatus;

a tray disposed adjacent to said ejector means, for receiving said recording cut sheet which has been ejected through said outlet by said ejector means; and a sheet reversing member disposed above said tray and having a lower guiding surface, said sheet reversing member being operable between a first position for guiding and reversing said recording cut sheet ejected through said outlet before the sheet falls onto said tray, and a second position for permitting said recording cut sheet ejected through said outlet to be received on said tray, without reversal of said cut sheet, said ejector means and said sheet reversing member placed in said first position cooperating with each other to permit a leading end portion of said recording cut sheet to be guided along said lower guiding surface, to thereby reverse said cut sheet.

14. A paper ejecting device according to claim 13, wherein said lower guiding surface of said sheet reversing member has a curved portion.

* * * * *